US005195863A

United States Patent [19]

De Pingon

[11] Patent Number: 5,195,863

[45] Date of Patent: Mar. 23, 1993

[54] EXCAVATOR LOADER

[76] Inventor: Pierre J. De Pingon, 7 Avenue du Parmelan, 74000 Annecy, France

[21] Appl. No.: 776,674

[22] Filed: Oct. 10, 1991

Related U.S. Application Data

[63] Continuation of Ser. No. 613,927, Nov. 8, 1990, abandoned, which is a continuation of Ser. No. 467,323, Jan. 18, 1990, abandoned, which is a continuation of Ser. No. 185,310, Apr. 20, 1988, abandoned, which is a continuation of Ser. No. 530,288, Sep. 7, 1983, abandoned.

[30] Foreign Application Priority Data

Sep. 8, 1982 [FR] France ..... 82 15231

[51] Int. Cl.[5] ..... E02F 3/28

[52] U.S. Cl. ..... 414/694; 414/715; 37/103

[58] Field of Search ..... 414/694, 697, 688, 706, 414/716, 695.5, 702, 687, 715; 37/103, DIG. 3

[56] References Cited

U.S. PATENT DOCUMENTS

| | | | |
|---|---|---|---|
| 3,149,737 | 9/1964 | Guinot | 414/694 |
| 3,703,973 | 11/1972 | Nilsson | 414/694 X |
| 3,807,586 | 4/1974 | Holopainen | 414/694 |
| 3,995,761 | 12/1976 | Hurlburt | 414/697 X |
| 4,122,959 | 10/1978 | Stedman | 414/694 |
| 4,122,960 | 10/1978 | Bauer et al. | 414/697 |
| 4,183,711 | 1/1980 | Schaeff | 414/687 X |
| 4,848,010 | 7/1989 | Zimmerman | 414/697 X |
| 5,054,990 | 10/1991 | Schaeff | 414/694 |

FOREIGN PATENT DOCUMENTS

| | | | |
|---|---|---|---|
| 0036850 | 9/1981 | European Pat. Off. . | |
| 737928 | 7/1943 | Fed. Rep. of Germany | 37/103 |
| 1007250 | 4/1957 | Fed. Rep. of Germany | 37/103 |
| 2011262 | 10/1970 | Fed. Rep. of Germany . | |
| 1948967 | 4/1971 | Fed. Rep. of Germany | 414/694 |
| 2308085 | 8/1974 | Fed. Rep. of Germany . | |
| 1756261 | 7/1978 | Fed. Rep. of Germany | 37/103 |
| 3331516 | 3/1984 | Fed. Rep. of Germany | 414/695.5 |
| 1147303 | 11/1957 | France | 414/688 |
| 1258980 | 3/1959 | France | 37/103 |
| 1178571 | 5/1959 | France . | |
| 1394238 | 2/1965 | France . | |
| 2073800 | 10/1971 | France . | |
| 2215516 | 8/1974 | France . | |
| 155453 | 4/1964 | U.S.S.R. | 37/103 |
| 1049927 | 1/1964 | United Kingdom . | |

OTHER PUBLICATIONS

Pettibone "Cary-Lift" Brochure May 1955, 34 pages.

*Primary Examiner*—Michael S. Huppert
*Assistant Examiner*—William M. Hienz
*Attorney, Agent, or Firm*—Darby & Darby

[57] ABSTRACT

This loader-excavator has a boom divided into an inner boom (9) and a main boom (18), the latter being articulated at the free end (17) of the inner boom. The inner boom is pivotally mounted near the front end of the turntable (3) of the machine, and can assume a position inclined to the rear, in which its free end lies to the rear of the axis of the turntable and is above it. In this position, the main boom can be folded onto the inner boom and it then extended horizontally forward, its front end being substantially above the front part of the machine. In this condition, the arm (24) bearing the tool can be directed vertically downward. This facilitates the work as a loader. For work as an excavator, the main boom is unfolded essentially to be an extension of the inner boom and it is locked relative to the latter.

9 Claims, 1 Drawing Sheet

EXCAVATOR LOADER

This is a continuation of application Ser. No. 613,927, filed Nov. 8, 1990 abandoned, which in turn is a continuation of Application Ser. No. 07/467,323 filed Jan. 18, 1990, now abandoned, which in turn is a continuation of Application Ser. No. 07/185,310 filed Apr. 20, 1988, abandoned, which in turn is a continuation of application Ser. No. 06/530,288 filed Sep. 7, 1983, abandoned.

BACKGROUND OF THE INVENTION

The present invention relates in a general way to earthmoving machinery.

Earthmovers include, for example, two types which are produced in very large numbers, namely, loaders and excavators.

Conventional loaders are self-propelled and have, at the front, a loading bucket which is usually about as wide as the machine itself. This bucket is filled by being pushed by the machine into the earth or into the materials to be loaded. Then it is raised, and the materials are carried by the machine to the transportation vehicles or to some other place, where they are unloaded.

Excavators have the function of digging in the ground. For this purpose, they have a tool that is generally mounted on a turntable which is usually of the full rotation type. This turntable in turn is borne by a self-propelled chassis.

These two functions are very different, and complementary at a give worksite. They therefore require two machines which likewise are different.

For small worksites, such a duplication of equipment is uneconomical. It should be possible for one machine to serve the two functions. With this in mind, loader-excavators have been built which have a loading bucket at the front and an excavator at the rear. But this combination of the two tools on a single chassis makes for a "bastard" machine and a complicated one, on which the excavation equipment handicaps the loading equipment. Furthermore, in a machine of this type, the excavator equipment cannot rotate fully and this rotation is even limited in many cases to about 180° C., which seriously hampers the work.

BRIEF DESCRIPTION OF THE INVENTION

The object of the invention is to embody a loader-excavator that can serve the said two functions, but possesses only one working tool, for example of the fully rotating type.

The invention is materialized in a loader-excavator composed of a self-propelled chassis on which a turntable is mounted. The turntable carries a working tool comprising a boom that can pivot on this turntable in a vertical plane. There is an arm articulated near the free end of this boom, and a tool mounted near the free end of the arm. The boom is subdivided into two parts forming an inner boom and a boom proper (main boom), these parts being articulated together so that they can, when working as a loader, be folded on one another and form an acute angle together. The inner boom is pointed obliquely upward and to the rear of the machine, while the main boom is folded on the inner boom and points forward. The front end of articulation of the arm of the main boom being situated, in this condition, substantially above the front end of the machine. For working as an excavator this inner boom and the main boom can occupy a position in which the main boom is substantially in the extension of the inner boom, or forms an open, obtuse angle with it, the inner boom and the main boom preferably constituting a rigid assembly in this condition.

According to one feature of the invention, when in the condition of working as an excavator, the boom folded on the inner boom preferably occupies a substantially horizontal position.

According to another feature, the free end of the boom is then by preference substantially above the front part of the front wheels of the machine.

According to still another feature, the inner boom is mounted pivotally on the front part of the turntable and its inclination to the rear of the machine is, when in the condition of working as a loader, such that the free end of this inner boom is distinctly to the rear of the vertical axis of the turntable and preferably distinctly above the latter, while the free end of the main boom, which extends to the front part of the machine, is distinctly ahead of this axis of the turntable.

In this condition, the arm can occupy a position that forms substantially a right angle with the boom and points in essentially a vertical direction.

When working as a loader, it then becomes possible to move the assembly formed by the boom and the arm around the free end of the stationary inner boom, which shifts the pivot point of this assembly far enough to the rear so that the loading bucket describes an arc of a circle while remaining substantially in line with the front wheels of the machine.

According to still another feature, the inner boom is mounted on the turntable so as to pivot between the said position inclined to the rear and a position pointing forward, preferably in a very low position.

Thus, when working as an excavator, the extended rigid assembly formed by the inner boom and the boom can swing with a wide amplitude. Since the working tool assembly has full rotation, the work can then be done as with a conventional excavator.

The construction according to the invention therefore makes it possible to embody a unit that combines on a single machine, work as a loader and work as an excavator, in spite of the contradictory requirements of these two functions.

When working as a loader, the loading height is much higher than that of a conventional loader since the assembly formed by the boom and the arm bearing the bucket pivot around the upper end of the inner boom, hence around a point situated in raised position. Yet the machine is very compact and the volume with the inner boom retracted to the rear and the boom folded, is small, which is advantageous both for road travel and for working.

In comparison with a conventional loader-excavator, visibility is much better in working with both functions. Moreover, as indicated above, the working tool retains a possibility of full rotation instead of a pivoting limited to about 180° C. In view of the arrangement adopted, the machine works from the front, and the balancing is easy and good, in contrast to conventional loader-excavators, because the two functions then require different balancing and present an insoluble problem. Furthermore, the driver never has to change his seat for working as a loader or an excavator as in the case with conventional machines. And finally, in difficult terrain, the driver has both the power to the wheels and the help of the excavating equipment whose wide clearances can greatly assist in extricating the machine from difficult positions, which is not the case for loader-excavators since the driver has to change his seat for each function. It will also be noted that it is obviously easier to build in a robust and economical fashion a single working tool rather than the two tools provided on conventional loader-excavators.

Although the invention will be advantageously applied to small machines, it is absolutely not confined thereto, and it can be applied equally well to machines of large size. It seems as a matter of fact possible to speak of a new generation of machines, having all the advantages of the two types of machines, the loaders and the excavators.

BRIEF DESCRIPTION OF THE DRAWINGS

The description which follows, given in reference to the attached drawing, and presented in non-limiting fashion, will permit a better understanding of the invention.

DETAILED DESCRIPTION OF THE INVENTION

Figure 1:
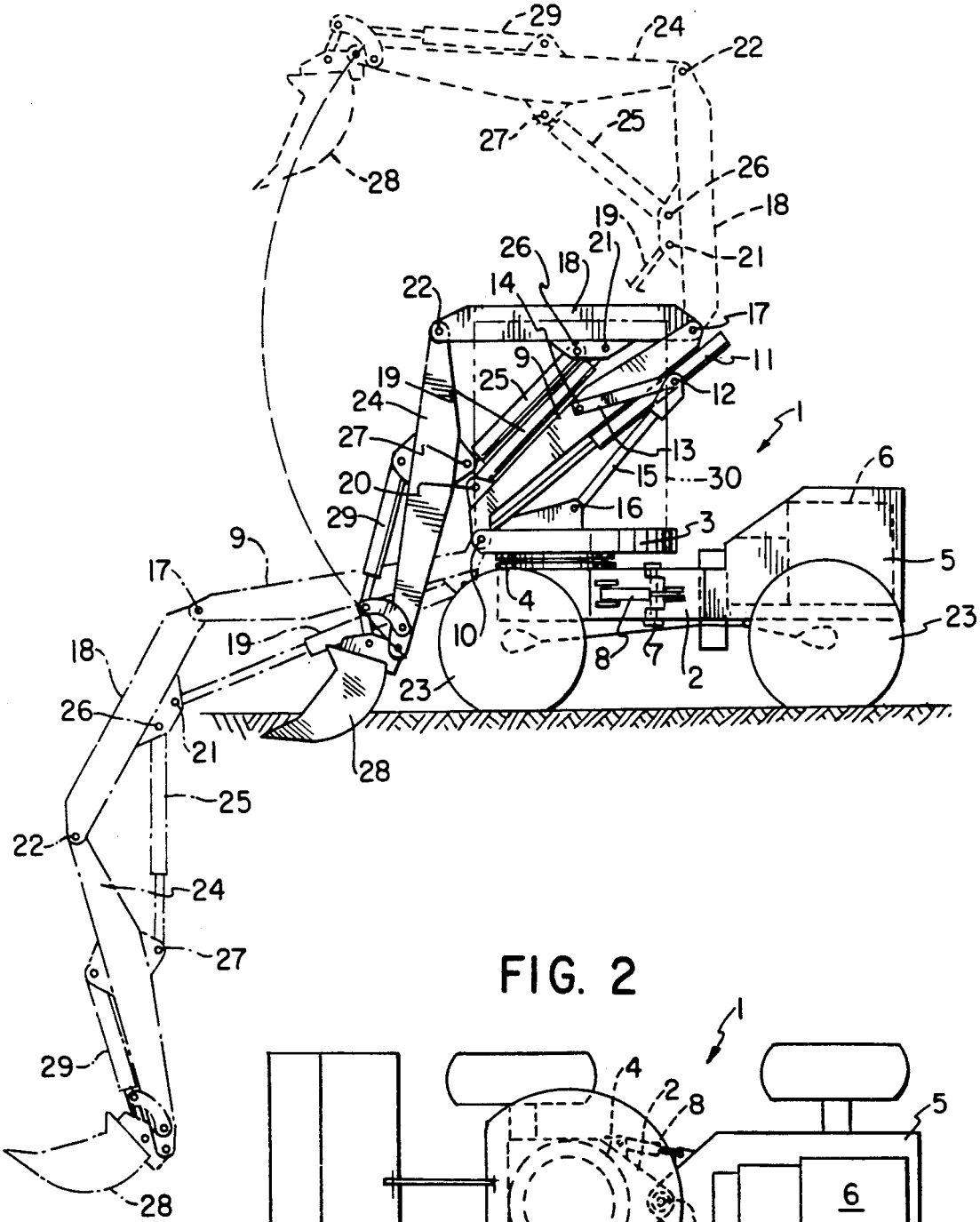
FIG. 1 is a schematic view in elevation of an embodiment of a loader-excavator according to the invention.
Figure 2:
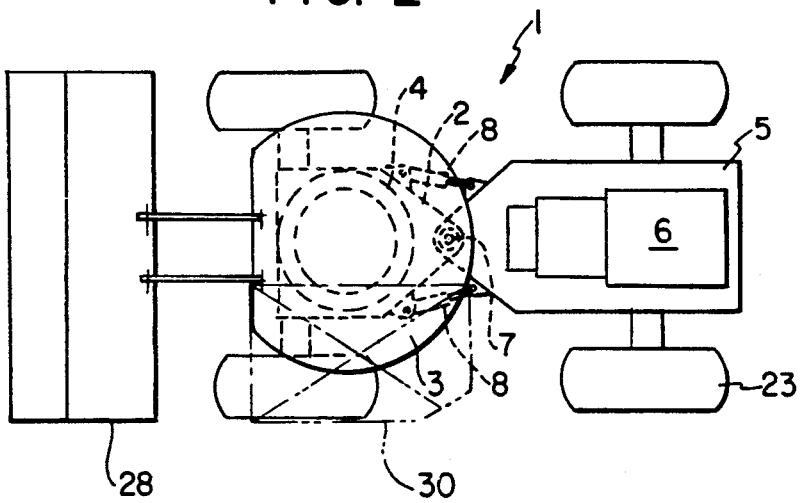
FIG. 2 is a plan view showing certain parts of the machine the turntable 3 not being shown.

The machine represented in the drawings has a chassis designated as a whole by reference 1. This, in the present case, is an articulated chassis composed of a front part 2 bearing a turntable 3 mounted on the chassis by means of a ball-bearing or roller mounted ring 4, as well as a rear part 5 on which is mounted the driving means 6, comprising, in conventional fashion, a motor, a gearbox or the like and a driving axle. The latter can also be linked to a front driving axle, in a manner well known to engineers specialized in this field.

Reference 7 indicates the axis of articulation between the two parts of the chassis 1, and 8 the jacks controlling the articulation of this chassis.

According to the invention, the single working tool borne by turntable 3 comprises an inner boom 9 (FIG. 1) mounted pivotally at 10 on the front part of this turntable so as to pivot in a vertical plane. Control of the pivoting of this inner boom 9 is provided by a jack 11 which is likewise articulated to the front part of the turntable by its piston rod, while the body is attached at 12 to an articulated parallelogram comprising a first pair of levers 13 linked at 14 to the jack body 11 and a second pair of levers 15 articulated to the turntable at 16 behind articulation 10 of the inner boom and jack 11. This solution is non-limiting.

The assembly is designed so that the inner boom 9 may pivot between a position of inclination to the rear and upward, indicated in bold lines in FIG. 1, in which its free end 17 is directly above the turntable and distinctly to the rear of the axis of the latter, and a position pointed forward and fully lowered as indicated at 9A.

The second element of the working tool is a boom 18 which is articulated at the upper end of inner boom at 17 and extends toward the front of the machine. The pivoting of this boom 18 relative to the inner boom is controlled by a jack 19 articulated at 20 on the front face of inner boom 9, near the bottom of the latter, and at 21 on the under face of boom 18. FIG. 1 shows that in the position of inner boom 9 retracted to the rear, boom 18 can extend forward in a substantially horizontal position, forming an acute angle with inner boom 9, jack 19 in inner position then being substantially parallel to this inner boom. In this condition, the front end 22 of boom 18 lies approximately above the front part of the front wheels 23 of the machine.

The third element of the work tool is constituted by an arm 24 articulated at 22 at the free end of boom 18. In the folded position shown in bold lines in FIG. 1, this arm 24 extends downward, forming substantially a right angle with boom 18. It is controlled by a jack 25 articulated at a point 26 close to articulation 21 on the under face of boom 18 and a point 27 provided on the rear face of arm 24. FIG. 1 also shows that in the folded position of the working tool, jack 25 is substantially parallel to jack 19 and to inner boom 9. Arm 24 then extends downward substantially to the ground, just in front of the front wheels 23 of the machine.

This arm 24 bears, at its lower end, the machine tool, represented here by a bucket 28 of some type, whose position relative to arm 24 is controlled by a jack 29 mounted in front of arm 24 in a substantially vertical position.

FIG. 1 shows that in folded position (solid line), the tool assembly takes up very little space, which facilitates movement of the machine on the road or the worksite.

Reference 30 indicates the cab of the machine which is mounted on the turntable laterally to the work tool.

The following is a description of the working of the machine as a loader and as an excavator.

In the working condition as a loader, inner boom 9 occupies the position of inclination to the rear, represented in solid lines in FIG. 1. The elements of this working tool first occupy, likewise, the position represented in solid lines, boom 18 being substantially horizontal and arm 24 extending essentially vertically downward, the loading bucket 28 being at ground level.

In this condition, the machine, by pushing, causes loading bucket 28 to penetrate into the ground or into the material, as in the case of a conventional loader. The position of the bucket 28 in the immediate vicinity of the front wheels 23 of the machine favors the working without comprising the equilibrium of the machine.

For loading, only jacks 19 and 29 are operated, while the other jacks retain the position represented (folded position).

The extension of jack 19 then raises boom 18 (dash lines) and with it, arm 24 and bucket 28, the latter describing an arc of a circle whose center lies at the point of articulation 17 of boom 18 on inner boom 9. This movement shifts the bucket only slightly away from its alignment with the front wheels of the machine owing to the substantial offset of this articulation 17 toward the rear of the machine. Operation of jack 29 moves the bucket 28 for loading in conventional fashion.

The dash lines represent the upper loading position obtained when boom 18 occupies a vertical position. It is clear that, owing to the position of articulation 17, the loading height is then very good, better than in conventional loaders; furthermore the loading bucket, in all of its positions, is far enough ahead of the machine to work and unload, without being so far ahead as to compromise stability.

For working as an excavator, jack 19 is extended to bring boom 18 into a position which is almost in alignment with the inner boom, as indicated, likewise, by the dot-dash lines in FIG. 1. Jack 19 is then left in this position, so that the inner boom and the boom constitute the equivalent of a normal excavator boom.

The excavator function is served, as with all conventional excavators, by the action of jack 11 to operate the inner boom 9 and boom 18 assembly, the action of jack 25 on arm 24, and the action of jack 29 on bucket 28.

It is evident, on reading the foregoing, that the two jacks 19 and 25 are never actuated together. Therefore, they can be operated, if desired from a single lever, equipped, for example, at its end with a selector. This makes it possible to operate the machine with the same levers both as a loader and an excavator.

Modifications can be made in the embodiment described, within the domain of technical equivalents, without departing from the invention.

I claim:

1. A loader-excavator, comprising:

a chassis mounted on wheels;

a turntable mounted on said chassis for rotation in a substantially horizontal plane about an axis, said turntable having a forward portion to be located at the front of said chassis and a rear portion, a boom assembly including:

an inner boom having one end pivotally attached to said forward portion of said turntable for arcuate movement in a vertical plane, an intermediate boom having one end pivotally connected to the other end of said inner boom for arcuate movement in a vertical plane relative to said inner boom, an implement arm having one end pivotally connected to the other end of said intermediate boom for arcuate movement in a vertical plane relative to said intermediate boom, and a work implement attached to the other end of said implement arm;

each of said inner boom, intermediate boom and implement arm being independently pivotable relative to each other;

operating means for operating said boom assembly as a loader including first means for pivoting said one end of said inner boom to pivot said inner boom to a first position in which said inner boom is angled back and upwards from the front portion of the turntable and extends backwards across said turntable toward its rear portion, third means for pivoting said one end of said implement arm relative to said other end of said intermediate boom for locating said implement arm substantially perpendicular to said intermediate boom, and second means for pivoting said one end of said intermediate boom relative to said other end of said inner boom to raise and lower the implement arm connected to the intermediate boom by moving said intermediate boom between a substantially horizontal position with its other end extending across and over the forward portion of the turntable with said implement arm directed downwardly to the ground and a substantially vertical position with said implement arm directed toward the horizontal;

said operating means operating the boom assembly as an excavator by operating said first means for pivoting said one end of said inner boom relative to said turntable for moving the inner boom from said first position for loading to a second position extending forwardly and outwardly of the forward position of said turntable and the chassis and substantially horizontally; and operating said second means for pivoting to pivot one end of said intermediate boom relative to said other end of said inner boom so that said intermediate boom is moved to extend vertically downwardly relative to said inner boom and said implement arm extends below said intermediate boom to position the work implement for excavation.

2. A loader-excavator as in claim 1, wherein during operation as a loader with said inner boom in said first position, said second means for pivoting pivots said one end of intermediate boom about said other end of said inner boom between an upper first position substantially parallel to said turntable axis and a lower second position substantially perpendicular to said turntable axis.

3. A loader-excavator as in claim 2, wherein said intermediate boom in said upper first position, said third means for pivoting is operable to pivot said one end of said implement arm relative to said other end of said intermediate boom between positions substantially parallel to and substantially perpendicular to said turntable axis.

4. A loader-excavator as in claim 1, wherein in said first position of said inner boom, said other end of said inner boom lies to the rear of said turntable axis, the other end of said implement arm is forward of said turntable.

5. A loader-excavator as in claim 2, wherein when said inner boom is in its first position and said intermediate boom is in its second position, said implement arm is pivotable by said third means for pivoting to extend substantially vertically downward toward the ground.

6. A loader-excavator as in claim 1, wherein said second means for pivoting includes jack means pivotably mounted between said inner boom and said intermediate boom for producing pivoting displacement of said intermediate boom relative to said inner boom.

7. A loader-excavator as in claim 1, wherein said third means for pivoting includes jack means pivotably mounted between said intermediate boom and said implement arm for producing pivoting displacement of said implement arm relative to said intermediate boom.

8. A loader-excavator as in claim 1, wherein said second means for pivoting includes first jack means pivotably mounted between said inner boom and said intermediate boom for producing pivoting displacement of said intermediate boom relative to said inner boom, and said third means for pivoting includes second jack means pivotably mounted between said intermediate boom and said implement arm for producing pivoting displacement of said implement arm relative to said intermediate boom.

9. A loader-excavator as in claim 8, and further comprising an adjustable selector attached to a lever, exclusive operation of one of said first jack means and said second jack means being selectably effected by said selector, said loader-excavator being alternately operable as an excavator or loader by manipulation of said lever and selector.

* * * * *